US007682288B1

(12) United States Patent
Stearns et al.

(10) Patent No.: US 7,682,288 B1
(45) Date of Patent: Mar. 23, 2010

(54) ELLIPTICAL EXERCISE METHODS AND APPARATUS

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 11/899,367

(22) Filed: Sep. 4, 2007

(51) Int. Cl.
*A63B 21/00* (2006.01)

(52) U.S. Cl. ..... 482/51; 482/52

(58) Field of Classification Search ..... 482/51, 482/52, 66, 72
See application file for complete search history.

(56) References Cited

U.S. PATENT DOCUMENTS

| | | | | |
|---|---|---|---|---|
| 5,762,588 | A | 6/1998 | Chen | 482/57 |
| 5,779,599 | A | 7/1998 | Chen | 482/57 |
| 5,967,944 | A | 10/1999 | Vittone | 482/52 |
| 6,277,055 | B1 | 8/2001 | Birrell | 482/52 |
| 6,514,180 | B1 * | 2/2003 | Rawls | 482/70 |
| 6,875,160 | B2 | 4/2005 | Watterson | 482/57 |
| 6,949,053 | B1 | 9/2005 | Stearns | 482/52 |
| 7,041,034 | B1 | 5/2006 | Stearns | 482/52 |
| 7,303,509 | B2 | 12/2007 | Schroder | 482/52 |
| 2002/0155926 | A1 * | 10/2002 | Lat | 482/52 |
| 2003/0216222 | A1 * | 11/2003 | Kuo | 482/52 |
| 2005/0181911 | A1 | 8/2005 | Porth | 482/52 |
| 2005/0272562 | A1 | 12/2005 | Alessandri | 482/52 |
| 2006/0046902 | A1 | 3/2006 | Chang | 482/52 |
| 2006/0217235 | A1 | 9/2006 | Schroder | 482/52 |
| 2008/0146417 | A1 * | 6/2008 | Chang | 482/70 |

* cited by examiner

*Primary Examiner*—Jerome Donnelly

(57) ABSTRACT

An exercise machine has foot supporting linkages that move a person's feet through respective left and right elliptical paths of motion that include a laterally directed component. Each linkage includes a crank that rotates about a crank axis, and a roller rotatably mounted on the crank for rotation about a roller axis that is skewed relative to the crank axis.

5 Claims, 10 Drawing Sheets

ELLIPTICAL EXERCISE METHODS AND APPARATUS

FIELD OF THE INVENTION

The present invention relates to exercise methods and apparatus, and more specifically, to exercise machines that facilitate exercise movement through an elliptical path.

BACKGROUND OF THE INVENTION

A variety of exercise machines have been developed to generate elliptical foot motion. An object of the present invention is to modify such machines so that a user's feet are movable through elliptical paths that are skewed relative to one another and/or relative to a longitudinal plane of symmetry defined by the machine.

SUMMARY OF THE INVENTION

An aspect of the present invention is to facilitate movement of a person's left and right feet through respective, elliptical paths of motion that are skewed relative to one another and/or relative to a longitudinal plane of symmetry extending between the person's feet.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

A preferred embodiment exercise machine constructed according to the principles of the present invention is designated as 100 in FIGS. 1-10. The machine 100 is similar in several respects to certain exercise machines disclosed in U.S. Pat. No. 6,171,215 to Stearns et al., which is hereby incorporated herein by reference to facilitate understanding of traditional elliptical motion exercise machines, as well as associated terminology and various design options. However, whereas these prior art machines generate left and right elliptical foot paths in adjacent left and right vertical planes, the machine 100 generates left and right foot elliptical foot paths that may be described as skewed relative to one another, and/or as having a lateral component.

Figure 3:
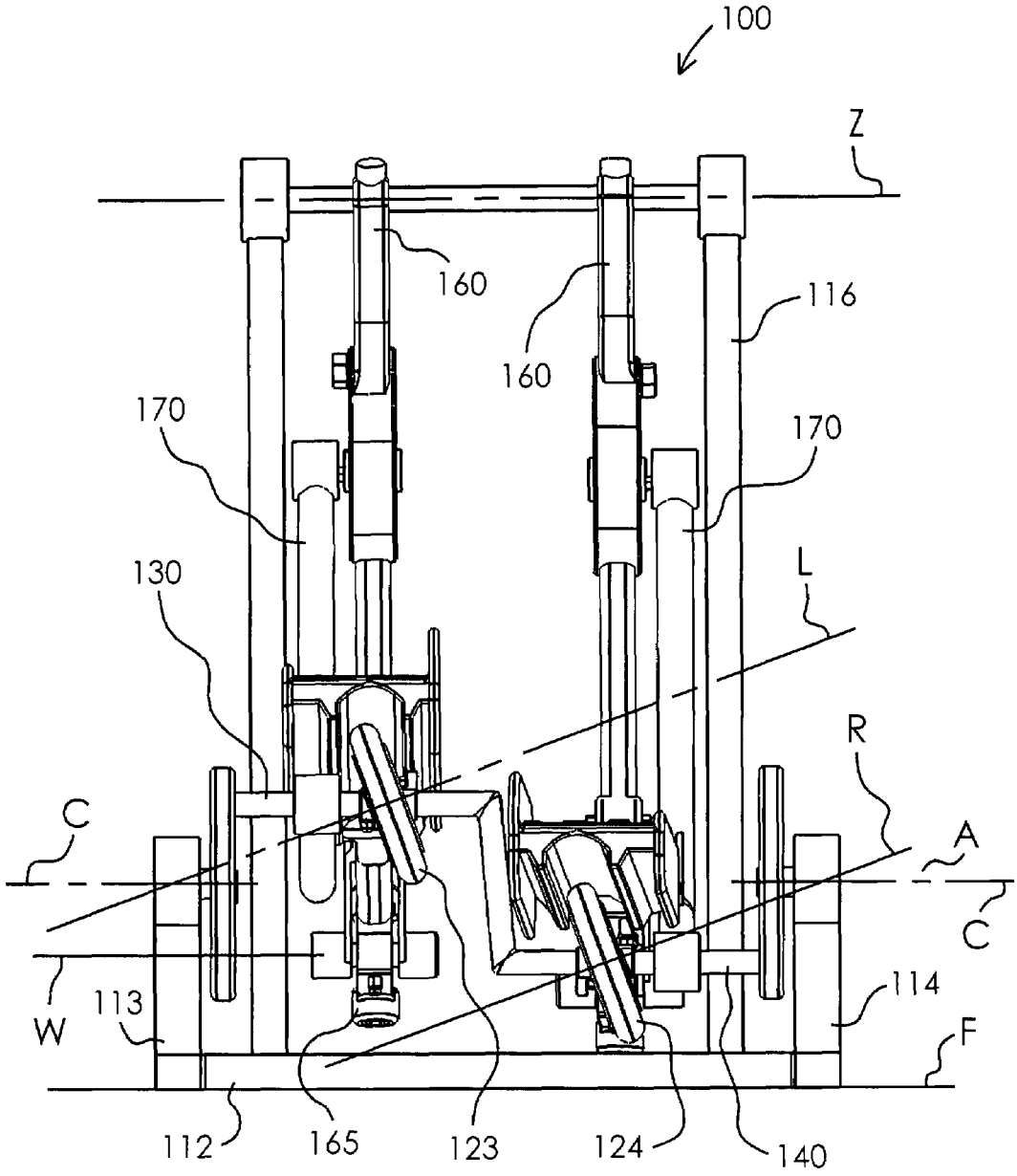
FIG. 3 is a rear view of the exercise machine of FIG. 1.
Figure 4:
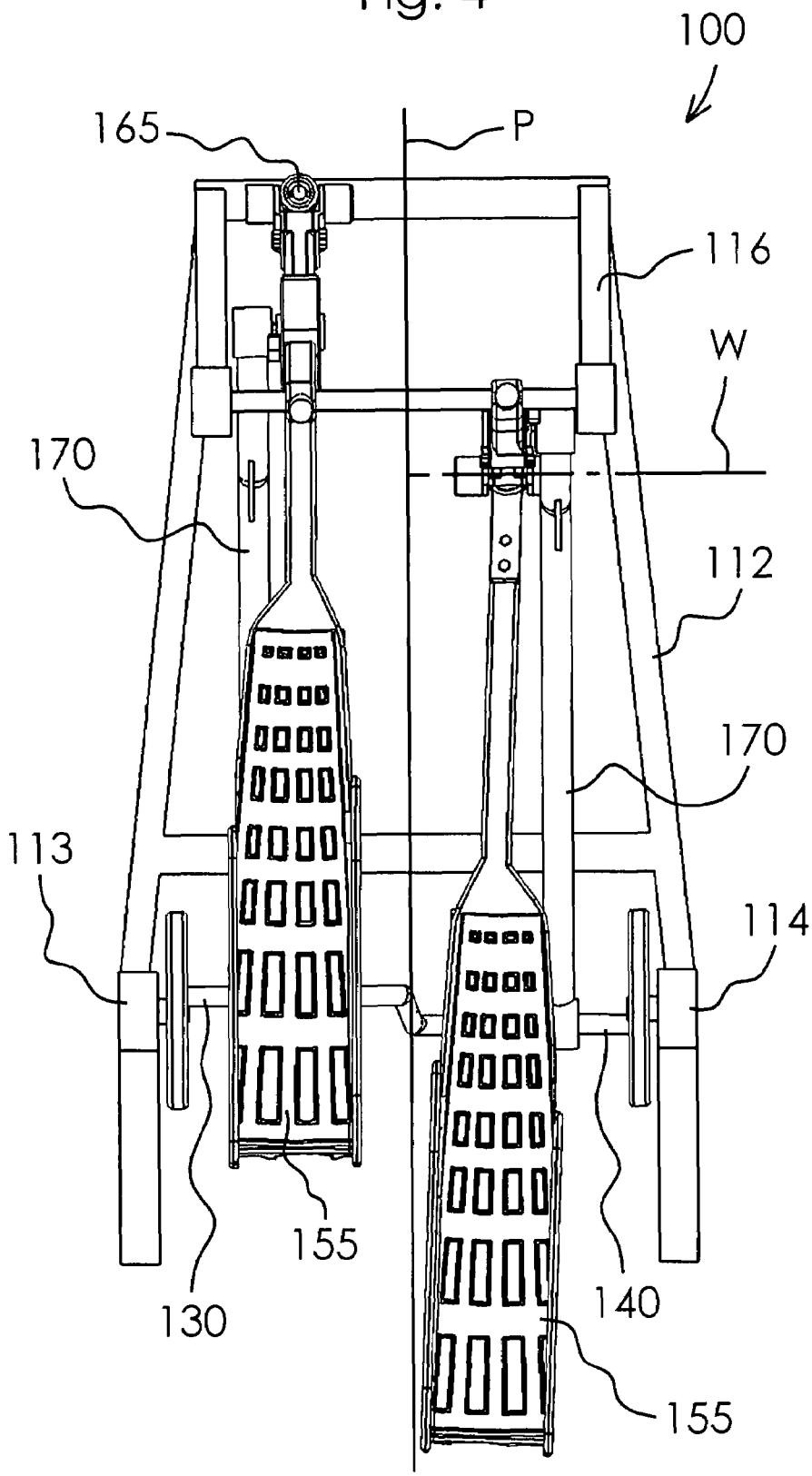
FIG. 4 is a top view of the exercise machine of FIG. 1.
Figure 5:
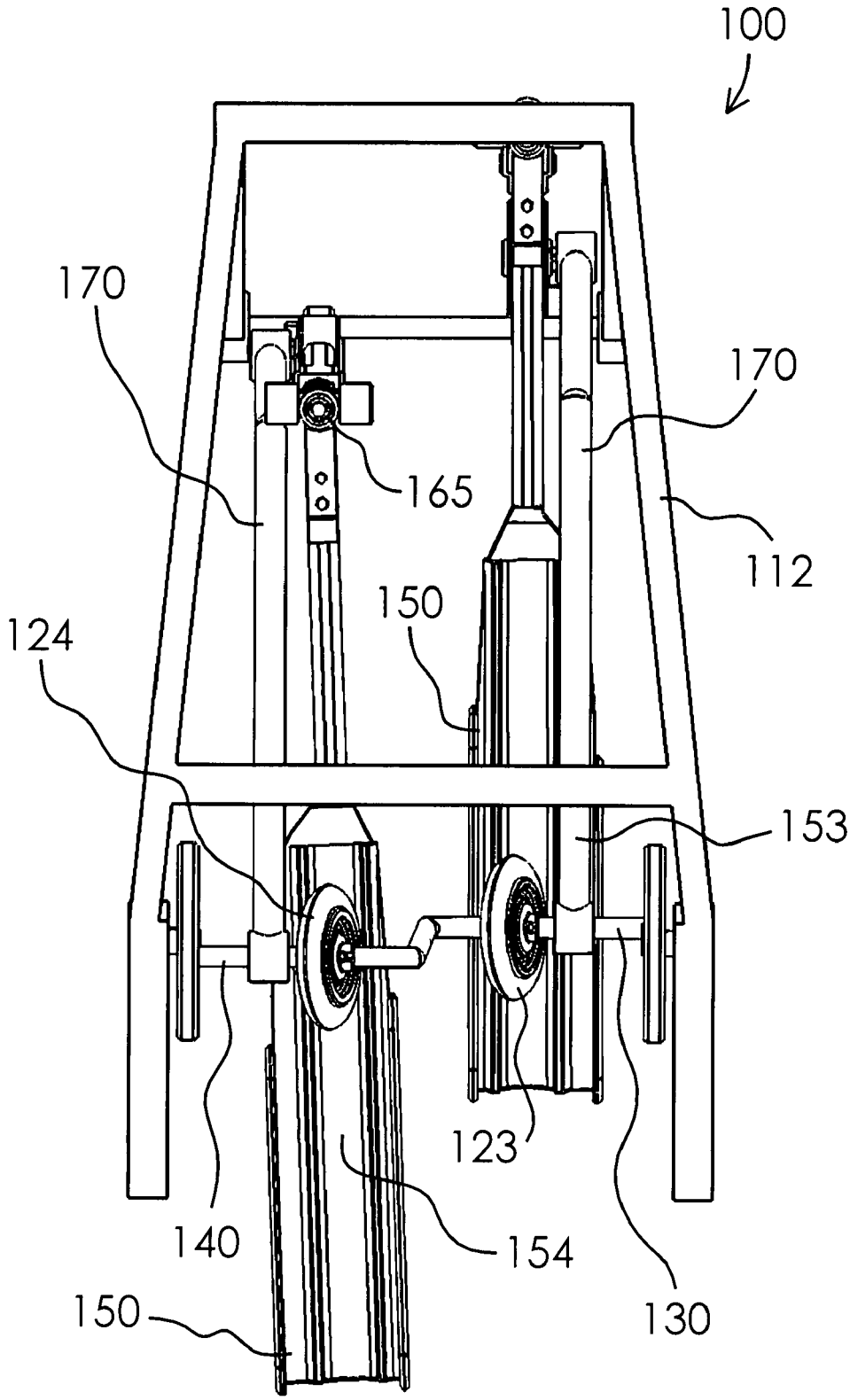
FIG. 5 is a bottom view of the exercise machine of FIG. 1.
Figure 6:
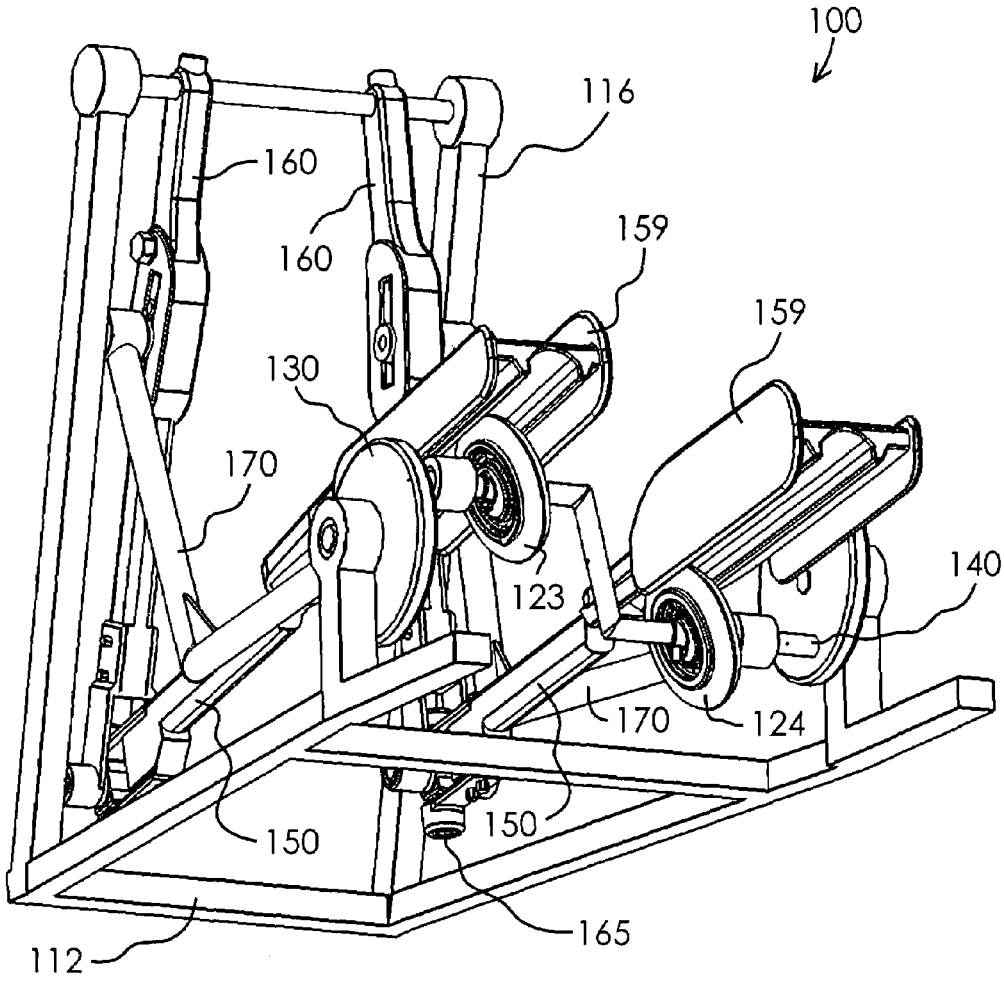
FIG. 6 is an alternative perspective view of the exercise machine of FIG. 1.
Figure 7:
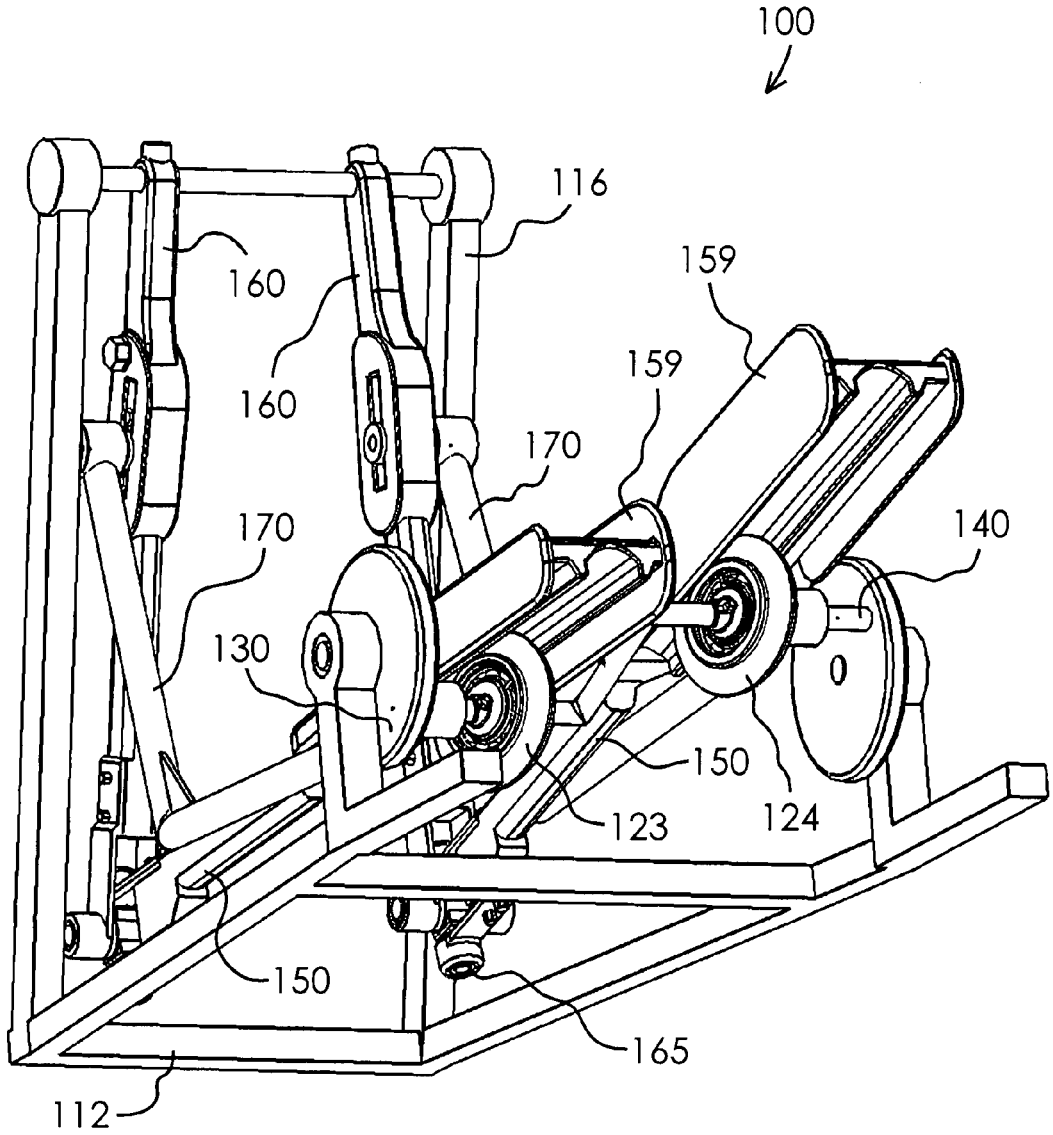
FIG. 7 is a similar perspective view of the exercise machine of FIG. 1, showing the machine at a different point in an exercise cycle.
Figure 8:
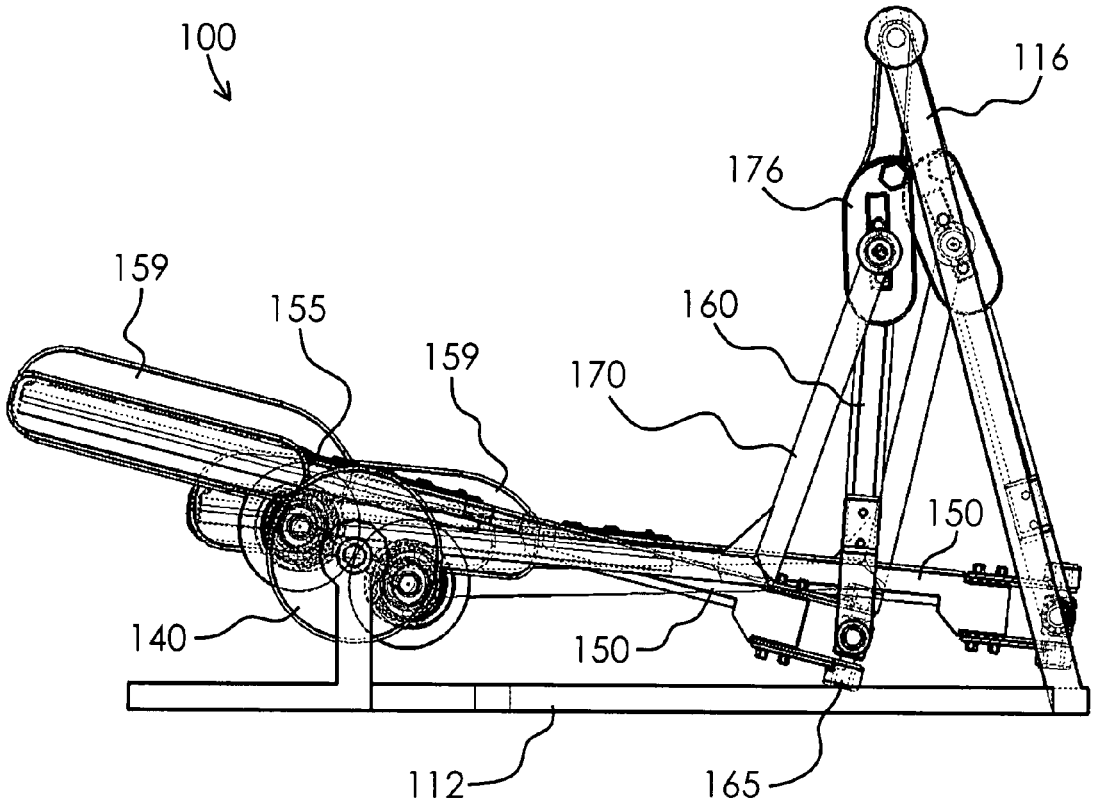
FIG. 8 is a right side view of the exercise machine of FIG. 1, showing the machine at the same point in an exercise cycle as shown in FIG. 7.
Figure 9:
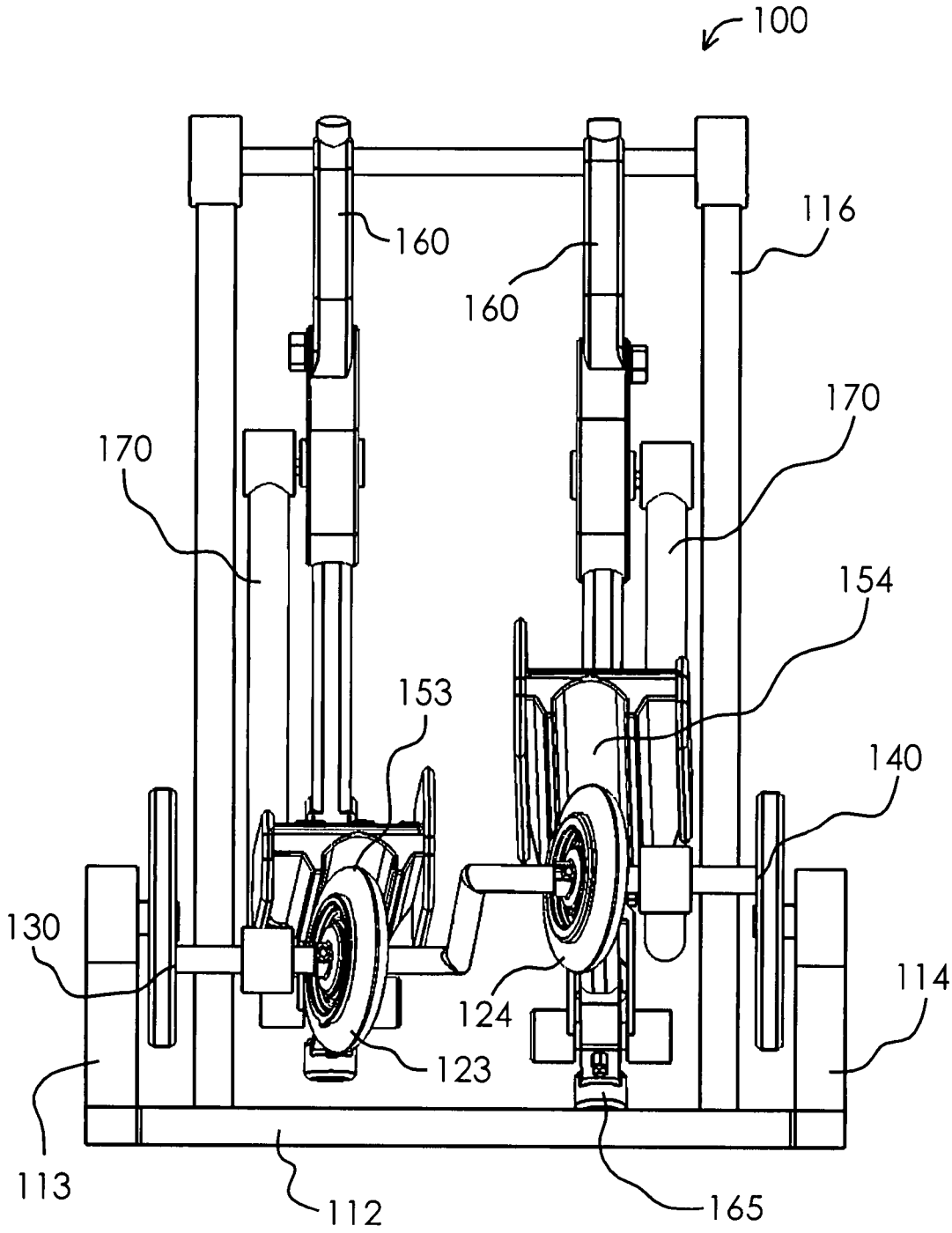
FIG. 9 is a rear view of the exercise machine of FIG. 1, showing the machine at the same point in an exercise cycle as shown in FIG. 7.
Figure 10:
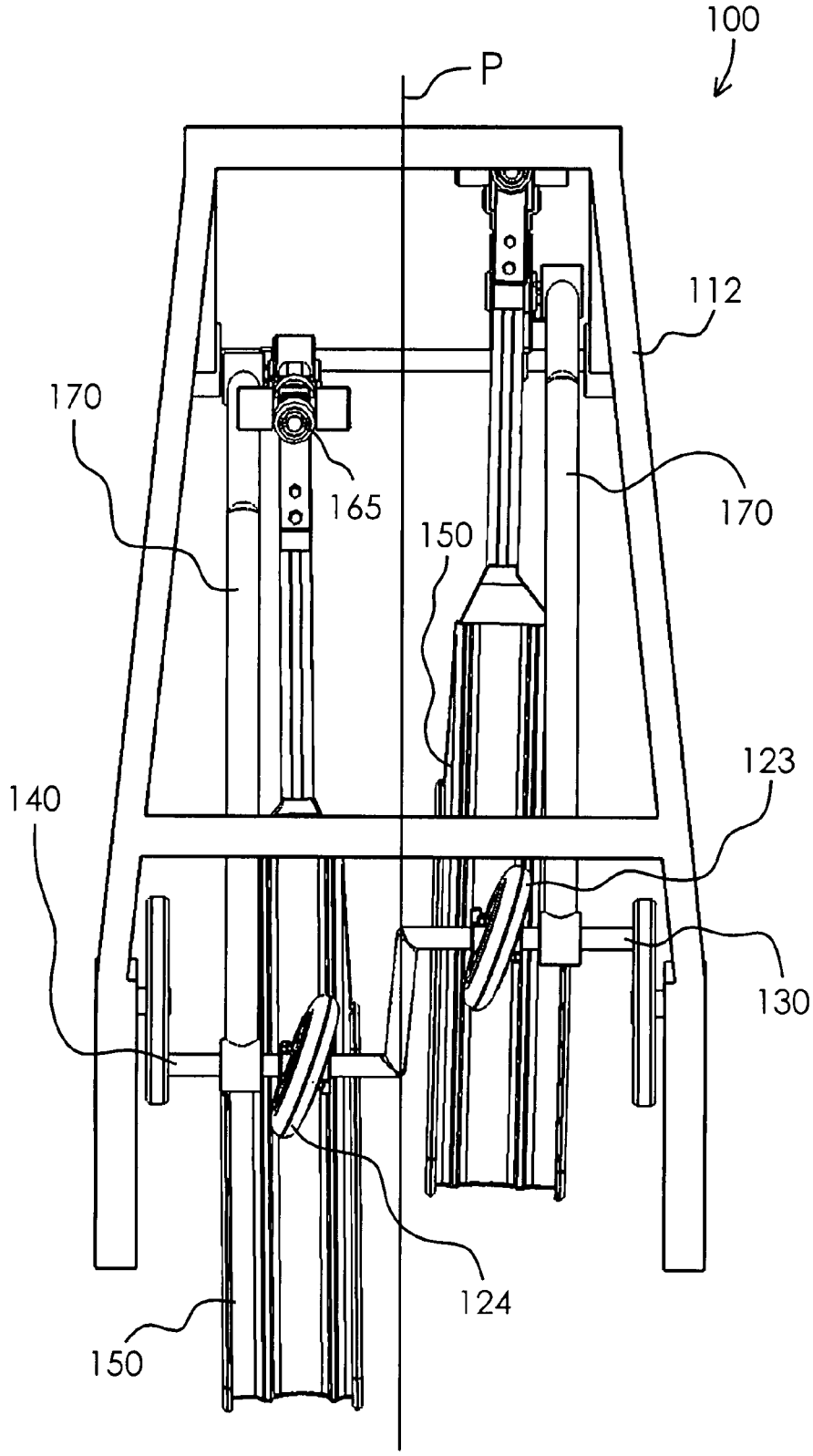
FIG. 10 is a bottom view of the exercise machine of FIG. 1, showing the machine at the same point in an exercise cycle as shown in FIG. 7.

The machine 100 includes a frame 110 having a base 112 that is configured and arranged to rest in place on a horizontal floor surface F (see FIG. 3). Left and right rearward supports 113 and 114 extend upward from respective rearward portions of the base 112 and rotatably support respective left and right cranks 130 and 140. A forward stanchion 116 extends upward from a forward portion of the base 112 and pivotally supports left and right rocker links 160. The forward stanchion 116 may be described as an inverted U-shaped member having a central rod that is preferably cylindrical in cross-section.

The apparatus 100 is generally symmetrical about a vertical plane (designated as P in FIG. 4) extending longitudinally through the base 112, the only noteworthy exception being the relative orientation of certain components on opposite sides of the plane of symmetry P (which are typically one hundred and eighty degrees out of phase relative to one another). Thus, when reference is made to parts on a particular side of the apparatus 100, it is to be understood that similar parts are disposed on the opposite side of the apparatus 100. Furthermore, to the extent that reference is made to "forward" or "rearward" portions of the apparatus 100, it is to be understood that a person could exercise on the apparatus 100 and/or a modified version of the apparatus 100 while facing in either direction relative to the cranks 130 and 140.

The left crank 130 may be described in terms of a left crank disc that is rotatably to the left crank support 113 for rotation about a crank axis C (see FIG. 3), and a left crank arm that is rigidly secured to the left crank disc at a radial distance from the crank axis C. Similarly, the right crank 140 may be described in terms of a right crank disc that is rotatably to the right crank support 114 for rotation about the same crank axis C (see FIG. 3), and a right crank arm that is rigidly secured to the right crank disc at the same radial distance from the crank axis C. The left and right crank arms are diametrically opposed relative to the crank axis C and cooperate to define a crank diameter therebetween.

A rigid bar is rigidly secured between the left crank arm and the right crank arm, thereby constraining the left and right cranks 130 and 140 to rotate together relative to the frame 110. Persons skilled in the art will recognize that various known inertia altering devices, including, for example, a motor, a "stepped up" flywheel, or an adjustable brake of some sort, may be operatively connected to one or both of the cranks 130 and 140 to link resistance and/or inertia to rotation of the cranks 130 and 140.

Persons skilled in the art will also recognize that a user interface may be mounted on the machine 100, including the central portion of the forward stanchion 116, for example, in order to perform functions such as (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

A left crank roller 123 is rotatably mounted on the left crank arm for rotation relative thereto about an axis L (see FIG. 3) that is skewed relative to the crank axis C. Similarly, a right crank roller 124 is rotatably mounted on the right crank arm for rotation relative thereto about an axis R (see FIG. 3) that is skewed relative to the crank axis C. The right roller axis R extends parallel the left roller axis L, and each roller axis R and L defines an angle A relative to the crank axis C. On the preferred embodiment 100, the angle A is twenty degrees. On alternative embodiments of the present invention, this angle may be changed in magnitude, and/or selectively adjusted to other fixed orientations, and/or varied during exercise activity.

As shown in FIG. 3, each crank roller 123 and 124 is arranged to lean or tilt toward its respective side of the apparatus 100 when its respective crank 130 or 140 occupies an uppermost orientation (12 o'clock), and to lean or tilt away from its respective side of the apparatus 100 when its respective crank 130 or 140 occupies a lowermost orientation (6 o'clock). On alternative embodiments of the present invention, this arrangement of the crank rollers may be different, and/or selectively adjusted to other fixed orientations, and/or varied during exercise activity. For example, the crank rollers may alternatively be arranged to lean or tilt toward its respective side of the apparatus 100 when its respective crank 130 or 140 occupies an forwardmost orientation (3 o'clock when viewed from the right side of the apparatus 100), and to lean or tilt away from its respective side of the apparatus 100 when its respective crank 130 or 140 occupies a rearwardmost orientation (9 o'clock when viewed from the right side of the apparatus 100).

Left and right foot supports 150 have rearward portions that are supported on respective crank rollers 123 and 124, and forward portions that are movable connected to lower portions of respective left and right rocker links 160. More specifically, the rearward portion of each foot support 150 has a respective downward facing bearing surface or race 153 or 154 (see FIG. 5) that is configured to remain in rolling contact with a respective crank roller 123 or 124. An opposite, upwardly facing bearing surface or foot platform 155 on each foot support 150 is configured to support a user's foot. Also, shields 159 may be provided on opposing, inwardly facing sides of the foot platforms 155 to shield a user's ankles against undesired contact with an opposite side foot support 150.

Figure 1:
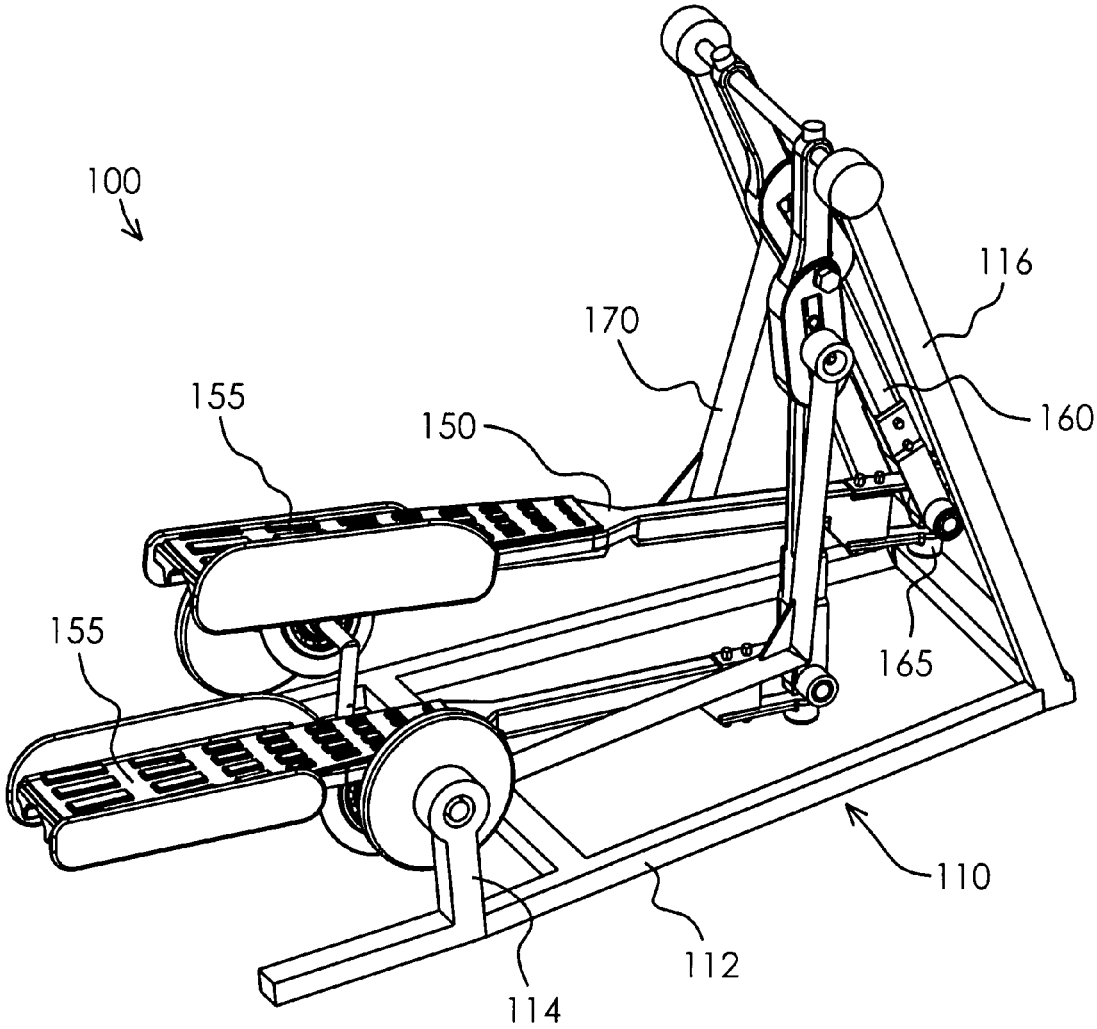
FIG. 1 is a perspective view of a preferred embodiment exercise machine constructed according to the principles of the present invention.
Figure 2:
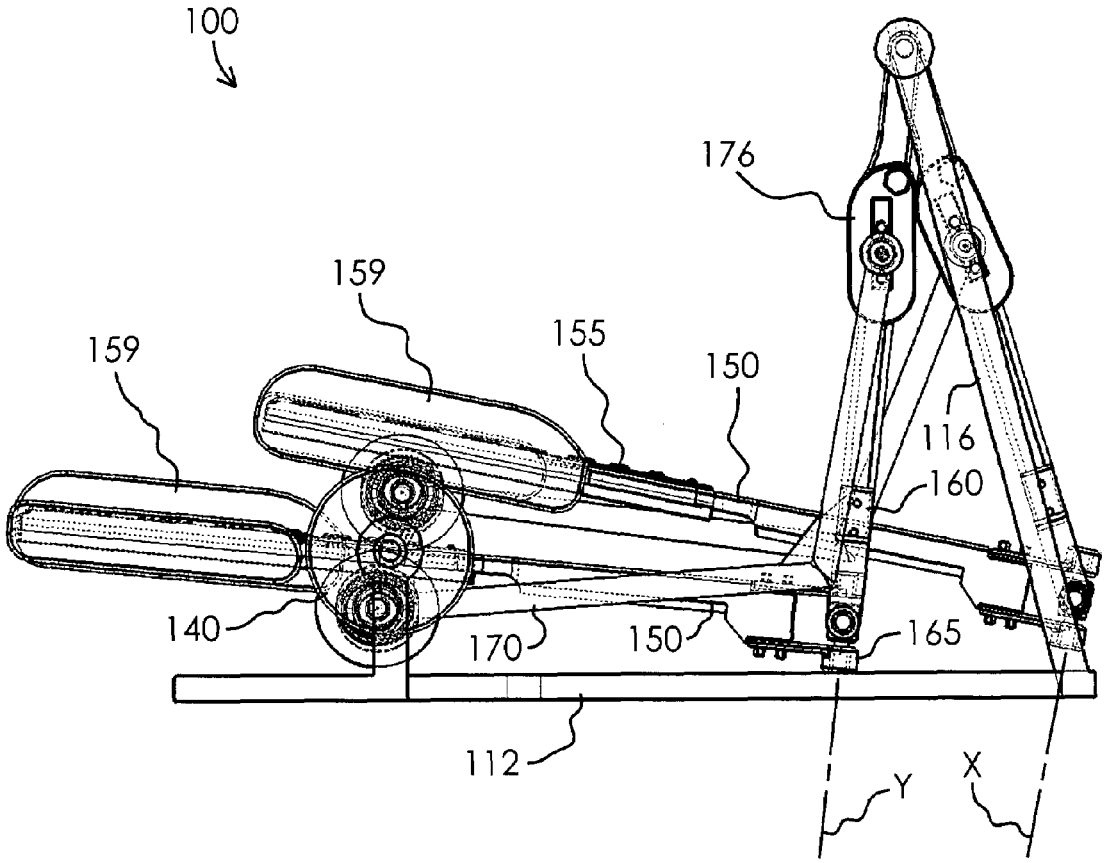
FIG. 2 is a right side view of the exercise machine of FIG. 1.

The forward portion of each foot support 150 is pivotally connected to a respective joint member 165, thereby defining a respective pivot axis X or Y (see FIG. 2). In turn, each joint member 165 is pivotally connected to a respective rocker link 160, thereby defining a respective pivot axis V (see FIG. 3) or W (see FIG. 4). The axis X extends perpendicular to the axis V, and the axis Y extends perpendicular to the axis W. The connections involving each joint member 165 establish what may be described as a universal joint between a respective foot support 150 and a respective rocker link 160.

An upper portion of each rocker link 160 is pivotally connected to the central portion of the forward stanchion 116 for pivoting about a common pivot axis Z (see FIG. 3). Persons skilled in the art will recognize that left and right handles may be secured to upper distal ends of respective rocker links 160 to guide a persons hands through reciprocal arcuate paths during rotation of the cranks 130 and 140.

Left and right drawbar links 170 have rearward ends rotatably connected to respective cranks 130 and 140, and forward ends rotatably connected to intermediate portions of respective rocker links 160. On the preferred embodiment 100, the pivot locations of the drawbar links 170 may be selectively repositioned long respective rocker links 160. In this regard, guides 176 are provided on respective rocker links 160 to facilitate repositioning of the drawbar links 170 relative thereto. Each guide 176 constrains a respective drawbar link 170 to slide along a respective rocker link 160, and a spring-biased fastener is selectively inserted through the drawbar link 170 and an aligned hole in the rocker link 160 to establish the pivotal connection therebetween. Recognizing that the drawbar pivot location is a first distance from the rocker pivot axis Z, and the foot support pivot location is a second, relatively greater distance from the rocker pivot axis Z, the rocker link 160 amplifies fore and aft movement of the foot support 150 as compared to fore and aft displacement of the associated crank 130 or 140. The extent of the amplification is adjusted by relocating the drawbar links 170 along the rocker links 160.

FIGS. 7-10 show the apparatus 100 at a different point in an exercise cycle as compared to FIGS. 1-6. As suggested by the foregoing description and a comparison of FIGS. 5 and 10, for example, the left crank roller 123 is arranged to guide a person's left foot "leftward" (away from the central plane P) when the left crank 130 moves toward an uppermost orientation relative to the frame 112, and to guide the person's left foot "rightward" (toward the central plane P) when the left crank 130 moves toward a lowermost orientation relative to the frame 112. Similarly, the right crank roller 124 is arranged to guide a person's right foot "leftward" (away from the central plane P) when the right crank 130 moves toward an uppermost orientation relative to the frame 112, and to guide the person's right foot "rightward" (toward the central plane P) when the right crank 130 moves toward a lowermost orientation relative to the frame 112.

Operation of the preferred embodiment 100 may also be described in terms of a power stroke portion of an exercise cycle, during which the user's feet are guided downward and then rearward at a laterally centralized region of the machine 100; and a return portion of an exercise cycle, during which the user's feet are guided upward and then forward at relatively greater lateral displacement from the centralized region of the machine 100. The resulting effect may be said to approximate motions associated with running, which for many people involves alternatively landing the left foot and the right foot on approximately the same line, and alternatively bringing the feet rearward with a lateral displacement to avoid collision with the opposite, forward moving foot.

As noted above, alternative embodiments of the present invention may be configured to generate different strokes during an exercise cycle and different resulting effects. In terms of approximating an alternative human activity, for example, an alternative embodiment may be configured to approximate motions associated with skating, which for many people involves alternatively moving each foot laterally outward during the power stroke (downward and then rearward), while bringing the opposite foot forward and inward (toward the central line of travel). Such an alteration may be accomplished simply by rotating the hub of each roller 123 and 124 relative to a respective crank 130 or 140, while maintaining the angle A therebetween. Such an alteration may be effected in various ways (manually or electromechanically) and/or directly or indirectly (in response to a control signal). Similarly, the magnitude of the angle A may be altered in similar manners, and an adjustment to zero angle may be to switch between a conventional elliptical exercise machine and a "3D" elliptical exercise machine.

Persons skilled in the art will recognize that the subject present invention may be described in terms of methods with reference to the foregoing embodiments; various modifications may be made to the foregoing embodiments; and the principles of the present invention may be applied to other known embodiments of elliptical exercise machines, as well. Among other things, the crank rollers may be canted at various angles, and/or directed toward any orientation for a given crank orientation. With the foregoing in mind, the subject invention should be limited only to the extent of the claims set forth below.

What is claimed is:

1. An exercise apparatus, comprising:

a frame configured to rest on a floor surface;

a left crank and a right crank, wherein each said crank is rotatably mounted on the frame;

a left roller and a right roller, wherein each said roller is rotatably mounted on a respective said crank for rotation relative thereto about a respective roller axis that is skewed relative to a respective said crank axis;

a left reciprocating member and a right reciprocating member, wherein each said reciprocating member is movably connected to the frame for movement relative thereto along a respective reciprocating path;

at least one left connector link movably interconnected between the left reciprocating member and the left crank in a manner that links rotation of the left crank to reciprocal movement of the left reciprocating member;

at least one right connector link movably interconnected between the right reciprocating member and the right crank in a manner that links rotation of the right crank to reciprocal movement of the right reciprocating member;

a left foot support having a first portion movably connected to the left reciprocating member, and a second portion supported on the left roller; and a right foot support having a first portion movably connected to the right reciprocating member, and a second portion supported on the right roller.

2. The exercise apparatus of claim 1, wherein the roller axis associated with the left roller extends parallel to the roller axis associated with the right roller.

3. The exercise apparatus of claim 1, wherein the left crank and the right crank rotate about a common crank axis.

4. The exercise apparatus of claim 1, wherein the left roller has an outwardly facing bearing surface that is centered about the roller axis associated with the left roller, and the right roller has an outwardly facing bearing surface that is centered about the roller axis associated with the right roller.

5. The exercise apparatus of claim 1, wherein the left roller is arranged to guide the person's left foot away from the right crank when the left crank moves toward an uppermost orientation relative to the frame, and the right roller is arranged to guide a person's right foot toward the left crank when the right crank moves toward a lowermost orientation relative to the frame.

* * * * *